US011785698B2

(12) United States Patent
Kobayashi

(10) Patent No.: US 11,785,698 B2
(45) Date of Patent: Oct. 10, 2023

(54) STATIC ELIMINATOR AND DROPLET EJECTION SYSTEM

(71) Applicant: FUNAI ELECTRIC CO., LTD., Osaka (JP)

(72) Inventor: Takeshi Kobayashi, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 104 days.

(21) Appl. No.: 17/584,327

(22) Filed: Jan. 25, 2022

(65) Prior Publication Data

US 2022/0256679 A1 Aug. 11, 2022

(30) Foreign Application Priority Data

Feb. 5, 2021 (JP) ..... 2021-017417

(51) Int. Cl.
*H05F 3/06* (2006.01)
*B41J 11/58* (2006.01)

(52) U.S. Cl.
CPC ..... *H05F 3/06* (2013.01); *B41J 11/58* (2013.01)

(58) Field of Classification Search
CPC ..... H05F 3/06; H05F 3/04; B41J 11/58; B41J 11/06; H01T 19/04
USPC ..... 361/235
See application file for complete search history.

(56) References Cited

U.S. PATENT DOCUMENTS

| | | | | |
|---|---|---|---|---|
| 9,649,858 | B2 * | 5/2017 | Suzuki | B41J 29/13 |
| 2005/0212871 | A1 * | 9/2005 | Kadomatsu | B41J 11/0021 347/76 |
| 2008/0136892 | A1 * | 6/2008 | Doi | B41J 2/0057 347/213 |
| 2020/0217763 | A1 | 7/2020 | Anderson, Jr. et al. | |
| 2022/0256679 | A1 * | 8/2022 | Kobayashi | H05F 3/06 |

FOREIGN PATENT DOCUMENTS

| | | | | |
|---|---|---|---|---|
| CN | 109986879 | A * | 7/2019 | |
| CN | 112136083 | A * | 12/2020 | B05D 3/14 |
| JP | 2012245622 | | 12/2012 | |
| JP | 6203659 | | 9/2017 | |
| JP | 2020082353 | A * | 6/2020 | |
| JP | 2020122781 | | 8/2020 | |
| JP | 2021058339 | A * | 4/2021 | A61J 1/035 |
| JP | 2022161568 | A * | 10/2022 | B65H 29/14 |

* cited by examiner

*Primary Examiner* — Dharti H Patel
(74) *Attorney, Agent, or Firm* — JCIPRNET

(57) ABSTRACT

Provided is a static eliminator that efficiently eliminates static electricity from a tray of a droplet ejection device of a tray transport type. A static eliminator 20 includes a movable part 22 which is pushed by a tray 12 due to movement of the tray 12 and moves, and an ion generator 24 disposed on a movement path of the tray 12 and configured to generate ions according to the movement of the movable part 22.

20 Claims, 6 Drawing Sheets

STATIC ELIMINATOR AND DROPLET EJECTION SYSTEM

CROSS-REFERENCE TO RELATED APPLICATION

This application claims the priority benefits of Japanese application no. 2021-017417, filed on Feb. 5, 2021. The entirety of the above-mentioned patent application is hereby incorporated by reference herein and made a part of this specification.

BACKGROUND

Technical Field

The disclosure relates to a static eliminator and a droplet ejection system.

Description of Related Art

Patent Document 1 (Japanese Patent Laid-Open No. 2020-122781) discloses a fluid droplet ejection system to which a printer of a tray transport type is applied.

Patent Document 2 (Japanese Patent No. 6203659) discloses an inkjet printer that eliminates static electricity generated in a recording medium by generating ions at the time of scanning with a carriage.

Patent Document 3 (Japanese Patent Laid-Open No. 2012-245622) discloses a screen printing device in which an ionizer that sprays a gas for static elimination can be incorporated by retrofitting.

However, in a printer device and a droplet ejection device of a tray transport type, there is a problem that static electricity accumulated in a tray may cause droplets ejected from a droplet ejection head to deviate from a target, resulting in deterioration of printing quality and ejection accuracy.

Therefore, the disclosure provides a static eliminator and a droplet ejection system that efficiently eliminate static electricity from a tray of a droplet ejection device of a tray transport type.

SUMMARY

A static eliminator according to one aspect of the disclosure is a static eliminator that eliminates static electricity from a tray of a droplet ejection device having a tray transport mechanism and includes a movable part which is pushed by the tray due to movement of the tray and moves, and an ion generator disposed on a movement path of the tray and configured to generate ions according to the movement of the movable part.

According to this, the static electricity of the tray can be efficiently eliminated in the droplet ejection device of a tray transport type. That is, the movable part and the ion generator are linked with movement of the tray. For example, the ion generator generates ions on the tray when the tray has moved below the ion generator and does not generate ions when the tray is not positioned below the ion generator. In this way, unnecessary ion generation can be curbed and an efficiency of eliminating static electricity can be improved.

Here, the movable part and the ion generator may be disposed outside a main body of the droplet ejection device, and the ion generator may generate ions in a direction toward an ejected portion of the tray in a state in which a part or all of the tray has been ejected from the main body of the droplet ejection device.

According to this, the static eliminator can be externally attached without changing the inside of an existing droplet ejection device.

Here, the ion generator may be placed on the movable part.

According to this, the ion generator is movable together with the movable part and can generate ions at a position corresponding to the movement of the tray.

Here, the static eliminator may include a switch which switches between an OFF state and an ON state according to movement of the movable part or the ion generator, and the ion generator may generate ions when the switch is in the ON state.

According to this, since ions are generated when, for example, the tray has moved below the ion generator, the static electricity can be efficiently eliminated without generating unnecessary ions.

Here, a base which supports the movable part, the ion generator, and the switch and is detachably attached to the droplet ejection device may be further provided.

According to this, the droplet ejection device can be detachably attached to the static eliminator.

Here, the base may include a shaft rod which supports a portion of the movable part, and the movable part may be movable to rotate around the shaft rod by being pushed by the tray.

According to this, since the tray moves a contact portion of the movable part in a circumferential direction, a load applied to the tray can be reduced.

Here, a portion of the ion generator may be supported by the shaft rod, the other portion of the ion generator may be placed on the movable part, and the switch may be switched between an ON state and an OFF state by the movement of the ion generator.

According to this, the switch can be switched between the ON state and the OFF state according to a rotation angle in the movement of the ion generator.

Here, the movable part may release the ion generator from being placed when an angle formed by the base and the movable part reaches a predetermined angle.

According to this, when the angle formed by the base and the movable part reaches the predetermined angle, a position of the ion generator can return to the initial state to switch the switch. As a result, generation of ions can be limited only to a period from the initial state until reaching the predetermined angle and further returning to the initial state. In this way, unnecessary ion generation can be curbed, and static electricity can be efficiently eliminated.

Here, the static eliminator may include a planar fan attached to the ion generator.

According to this, when the ion generator returns from a state of the predetermined angle to the initial state, an air flow can be generated on the tray by the fan to move ions on the tray. In other words, the static eliminator can perform windless static elimination during a period from the initial state until reaching the predetermined angle and can perform wind static elimination during a period from the predetermined angle until returning to the initial state.

Here, the static eliminator may include an angle designation part which designates the predetermined angle.

According to this, it is possible to adjust a period of the windless static elimination and a period of the wind static elimination according to until when the angle formed by the base and the movable part reaches the predetermined angle.

For example, the angle can be appropriately designated with respect to a depth (y-axis) of a static elimination object, and can be designated as a small angle when the depth is small and as a large angle when the depth is large. As a result, the static electricity can be efficiently eliminated.

Here, the static eliminator may include a planar side guard connecting the base and a lateral side of the fan.

According to this, dissipation of ions from the tray can be suppressed, and an efficiency of the static elimination can be further improved.

Also, a static eliminator according to one aspect of the disclosure is a static eliminator that eliminates static electricity from a tray of a droplet ejection device having a tray transport mechanism and includes a movable part which is pushed by the tray due to movement of the tray and moves, a switch which switches between an OFF state and an ON state according to movement of the movable part, an ion generator disposed on a movement path of the tray and configured to generate ions on the tray according to the ON state of the switch, and a base which supports the movable part, the ion generator, and the switch and is detachably attached to the droplet ejection device.

According to one aspect of the disclosure, a method eliminating static electricity from a tray of a droplet ejection device is provided, which comprises enabling generation of ions when the tray starts moving out of the droplet ejection; blowing the ions to the tray to eliminate the static electricity from the tray; and disabling the generation of the ions when the tray is sent out.

According to this, the static electricity of the tray can be efficiently eliminated in the droplet ejection device of a tray transport type. That is, the movable part and the ion generator are linked with movement of the tray. For example, the ion generator generates ions on the tray when the tray has moved below the ion generator and does not generate ions when the tray is not positioned below the ion generator. In this way, unnecessary ion generation can be curbed and an efficiency of eliminating static electricity can be improved.

Here, a planar fan attached to the ion generator may be further provided, the base may include a shaft rod supporting a portion of the movable part and a portion of the ion generator, the other portion of the ion generator may be placed on the movable part, the movable part may release the ion generator from being placed when an angle formed by the base and the movable part reaches a predetermined angle, and the ion generator may return to an initial state due to the release to switch the switch.

According to this, when the ion generator returns from a state of the predetermined angle to the initial state, an air flow can be generated on the tray by the fan to move ions on the tray. In other words, the static eliminator can perform windless static elimination during a period from the initial state until reaching the predetermined angle and can perform wind static elimination during a period from the predetermined angle until returning to the initial state.

Also, a droplet ejection system according to one aspect of the disclosure includes the static eliminator described above, and a droplet ejection device of a tray transport type to which the static eliminator is attached.

According to this, the static electricity of the tray can be efficiently eliminated in the droplet ejection device of a tray transport type. That is, the movable part and the ion generator are linked with movement of the tray. For example, the ion generator generates ions on the tray when the tray has moved below the ion generator and does not generate ions when the tray is not positioned below the ion generator. In this way, unnecessary ion generation can be curbed and an efficiency of eliminating static electricity can be improved.

Further, the disclosure can be realized not only as the static eliminator including a control unit that executes the characteristic processing described above, but also as a method in which the characteristic processing included in the static eliminator is used as a step.

Also, the disclosure can be realized not only as the droplet ejection system including a control unit that executes the characteristic processing described above, but also as a method in which the characteristic processing included in the droplet ejection system is used as a step.

The static eliminator and the droplet ejection system of the disclosure can efficiently eliminate static electricity from a tray of a droplet ejection device of a tray transport type.

DESCRIPTION OF THE EMBODIMENTS

Hereinafter, embodiments of a static eliminator and a droplet ejection system according to one aspect of the disclosure will be specifically described with reference to the drawings. Further, all of the embodiments described below are comprehensive or specific examples of the disclosure. Numerical values, shapes, materials, components, disposition positions and connection forms of components, steps, a sequence of steps, or the like illustrated in the following embodiments are examples, and are not intended to limit the disclosure. Also, of the components in the following embodiments, components not described in the independent claims indicating the most significant concept are described as arbitrary components.

Embodiments

[Configuration of Droplet Ejection System]

Figure 1:
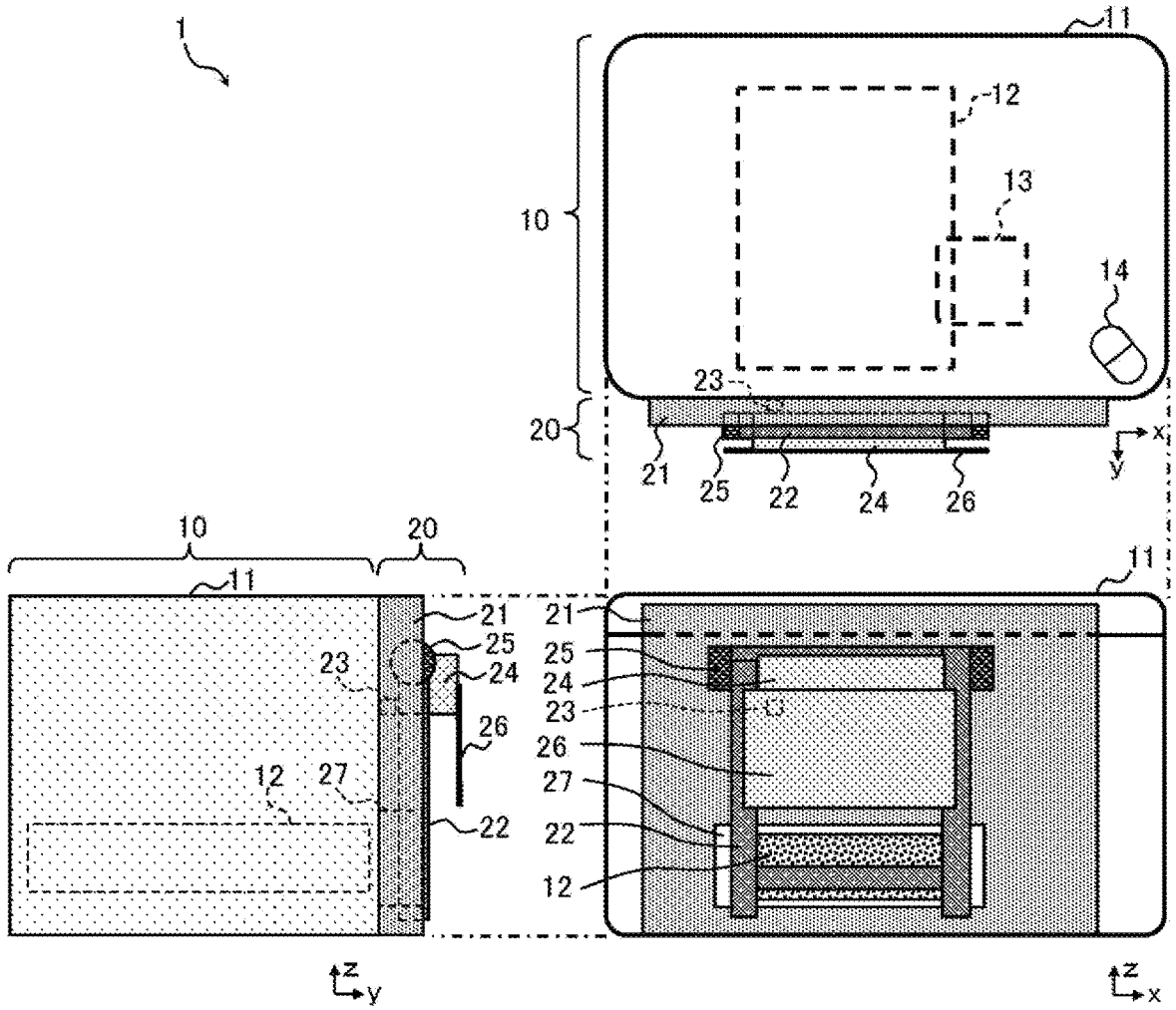
FIG. 1 is a view illustrating a configuration example of a droplet ejection system of an embodiment.

FIG. 1 is a view illustrating a configuration example of a droplet ejection system of an embodiment. FIG. 1 is a three-view drawing of a droplet ejection system 1 as viewed from above, the front, and the lateral side. The droplet ejection system 1 in FIG. 1 includes a printer device 10 and a static eliminator 20.

Figure 2:
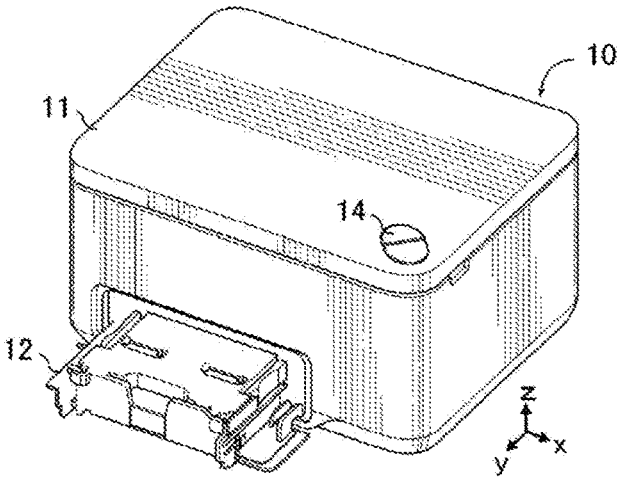
FIG. 2 is a view illustrating an example of an external appearance of a printer device.

The printer device 10 is an example of a droplet ejection device having a tray transport mechanism and is a device similar to an inkjet printer that prints an object on a tray or ejects droplets. FIG. 2 is a view illustrating an example of an external appearance of the printer device 10. FIG. 2 illustrates a state in which a portion of a tray 12 is ejected from a printer main body 11, but the entire tray 12 is able to be accommodated in the printer main body 11.

As illustrated in FIG. 1, the printer device 10 includes the printer main body 11, the tray 12, a cartridge 13, and a switch 14.

The printer main body 11 includes a first transport mechanism that moves the cartridge 13 in a direction along an x-axis, and a second transport mechanism that moves the tray 12 in a direction along a y-axis. The first transport mechanism moves the cartridge 13 in the direction along the x-axis on the tray 12. The second transport mechanism moves the tray 12 in the direction along the y-axis. A tray doorway is provided on a front surface of the printer main body 11. The second transport mechanism allows a part or all of the tray 12 to be put in and taken out of the doorway. For example, an object may be set by a user with most of the tray 12 having been sent out from the doorway. Also, static elimination of the tray 12 by the static eliminator 20 is performed when a part or all of the tray 12 is sent out from and drawn into the tray doorway.

The tray 12 is loaded with an object to be printed on or an object on which droplets are to be ejected and is able to be ejected to the outside through an opening 27 of the printer main body 11 by the second transport mechanism.

The cartridge 13 includes a tank for storing droplets of ink or a sample and a droplet ejection head, and prints or ejects the droplets onto the object on the tray 12.

The switch 14 is a power switch.

The static eliminator 20 includes a base 21, a movable part 22, a switch 23, an ion generator 24, an angle designation knob 25, and a fan 26.

The base 21 is a member that supports the movable part 22, the switch 23, and the ion generator 24 and is detachably attached to the printer main body 11. The base 21 has a shaft rod that supports a portion of the movable part 22, a portion of the ion generator 24, and an angle designation knob 25. Also, the base 21 has the opening 27 that overlaps the tray doorway of the printer main body 11. A size of the opening 27 is approximately the same as or larger than a doorway of the printer main body 11.

Figure 3A:
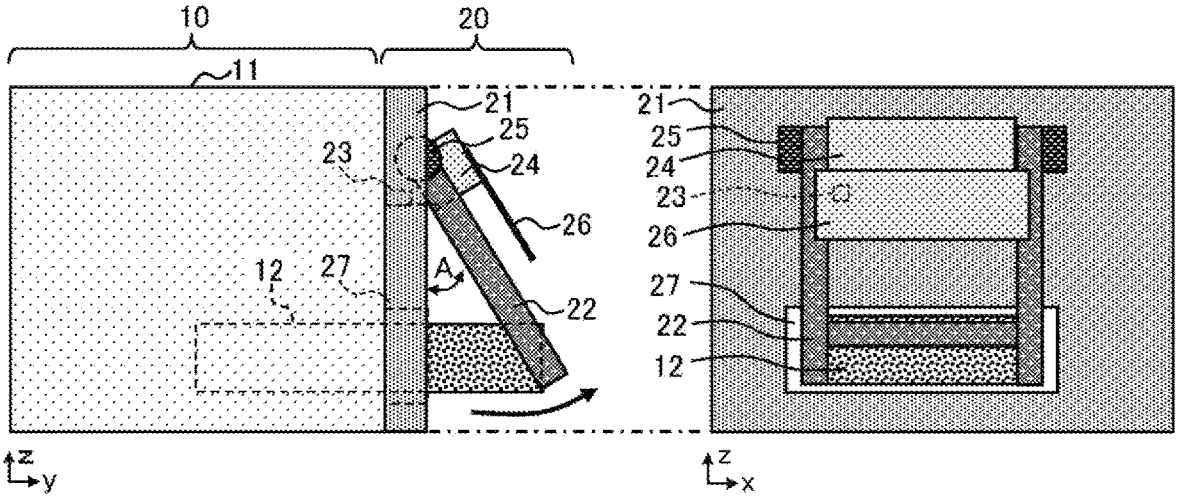
FIG. 3A is a view illustrating a state of a static eliminator during windless static elimination by a droplet ejection system of the embodiment.

The movable part 22 is movable by rotating around the shaft rod by being pushed by the tray 12 that is sent out from the opening 27. Movement of the movable part 22 at this time is illustrated in FIG. 3A. As illustrated in FIG. 3A, an angle formed by the movable part 22 and the base 21 is referred to as an angle A. When the movable part 22 and the tray 12 are not in contact with each other, the angle A is 0 degrees. When the movable part 22 is pushed in the y direction by the tray 12 and moves, the angle A becomes larger than 0 degrees. As the sent-out amount of the tray 12 from the printer main body 11 becomes larger, the angle A becomes larger. Eliminating static electricity from the tray 12 with ions generated in the ion generator 24 in the state of FIG. 3A is referred to as windless static elimination.

Also, the ion generator 24 is placed on the movable part 22. Due to this placement, the ion generator 24 is also movable according to the movement of the movable part 22. Further, when the angle A reaches the predetermined angle as the tray 12 is sent out, the movable part 22 releases the placement of the ion generator 24. Due to this release, a position of the ion generator 24 returns to an initial state. The initial state of the ion generator 24 is a state in which an angle formed by the base 21 and the ion generator 24 is approximately 0 degrees. The predetermined angle may be, for example, 30 degrees, 45 degrees, or the like.

The switch 23 switches between an OFF state and an ON state according to the movement of the movable part 22. The switch 23 is a switch for switching whether or not to cause the ion generator 24 to generate ions. For example, when the switch 23 is in an OFF state, the switch 23 cuts off supply of power to the ion generator 24 or disables the ion generator 24. Conversely, when the switch 23 is in an ON state, the switch 23 supplies power to the ion generator 24 or enables the ion generator 24. Therefore, for example, when the movable part 22 is not in contact with the tray 12, that is, when the angle A is 0 degrees, the switch 23 is in an OFF state. When the movable part 22 is brought into contact with the tray 12 and is moved, for example, when the angle A is equal to or higher than a certain value, the switch 23 is in an ON state. Here, the certain value may be, for example, about several degrees and corresponds to a distal end of the tray 12 being sent out until it is positioned below the ion generator 24.

Further, the switch 23 may switch between an OFF state and an ON state according to movement of the ion generator 24 instead of the movable part 22. For example, when the ion generator 24 is in the initial state with the tray 12, the switch 23 is in an OFF state. When the ion generator 24 placed on the movable part 22 is moved, the switch 23 is in an ON state.

The ion generator 24 generates ions when the switch 23 is in an ON state. For example, when a part or all of the tray 12 is sent out from the printer main body 11, the ion generator 24 generates ions on the tray 12.

Further, a portion of the ion generator 24 is supported by the shaft rod of the base 21. The other portion of the ion generator 24 is placed on the movable part 22. As a result, the ion generator 24 moves in the same manner as the movable part 22 moves. That is, the ion generator 24 is movable to rotate around the shaft rod.

The angle designation knob 25 designates a predetermined angle. The angle designation knob 25 selectively designates, for example, one of 30 degrees and 45 degrees as the predetermined angle. In this case, the angle designation knob 25 is set to one of a rotation position corresponding to 30 degrees and a rotation position corresponding to 45 degrees by a user operation. According to this, it is possible to adjust a period of the windless static elimination and a period of wind static elimination according to until when the angle A reaches the predetermined angle. For example, the angle can be appropriately designated with respect to a depth (y-axis) of a static elimination object, and can be designated as a small angle when the depth is small and as a large angle when the depth is large. As a result, the static electricity can be efficiently eliminated. Further, the predetermined angle designated by the angle designation knob 25 is not limited to 30 degrees and 45 degrees, and may be selectively designated from N angles, or can be designated from any angle included in a certain angle range.

Figure 3B:
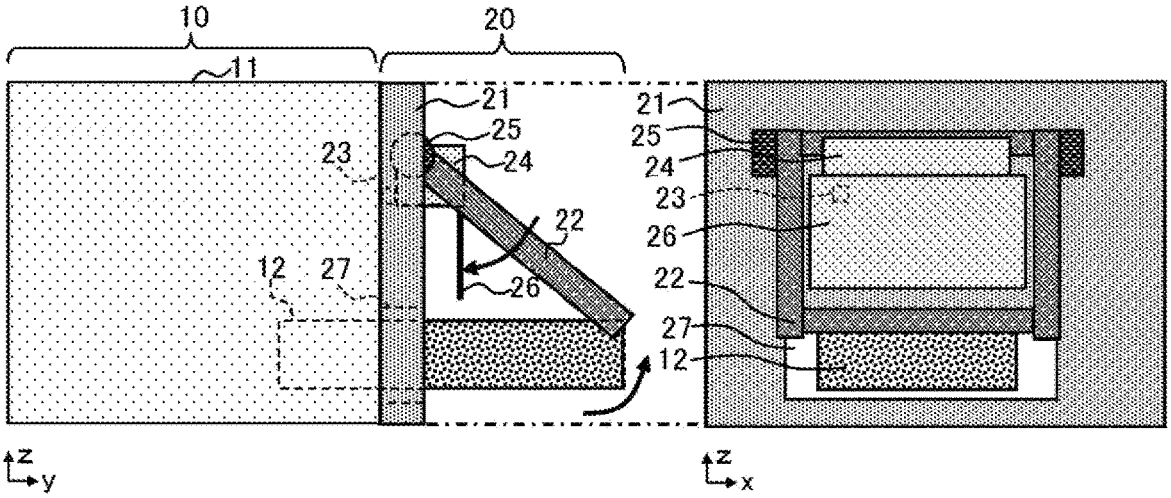
FIG. 3B is a view illustrating a state of the static eliminator during wind static elimination by the droplet ejection system of the embodiment.

The fan 26 is a plate attached to a surface of the ion generator 24. When the movable part 22 releases the placement of the ion generator 24, the ion generator 24 returns from a state of the predetermined angle to the initial state. In this return, the ion generator 24 at the predetermined angle is returned to the initial state by a pendulum operation due to a weight thereof. The pendulum operation of the ion generator 24 at this time is illustrated in FIG. 3B. As illustrated in FIG. 3B, when the angle A reaches the predetermined angle due to the movement of the movable part 22, the ion generator 24 and the fan 26 perform a pendulum operation. The fan 26 generates an air flow on the tray 12 due to the pendulum operation. The airflow moves ions on the tray 12. Thereby, an efficiency of the static elimination of the tray 12 can be further improved. The operation of static elimination during a period from such a predetermined angle until returning to the initial state is referred to as the wind static elimination.

[Configuration Example of Movable Part 22]

Figure 4:
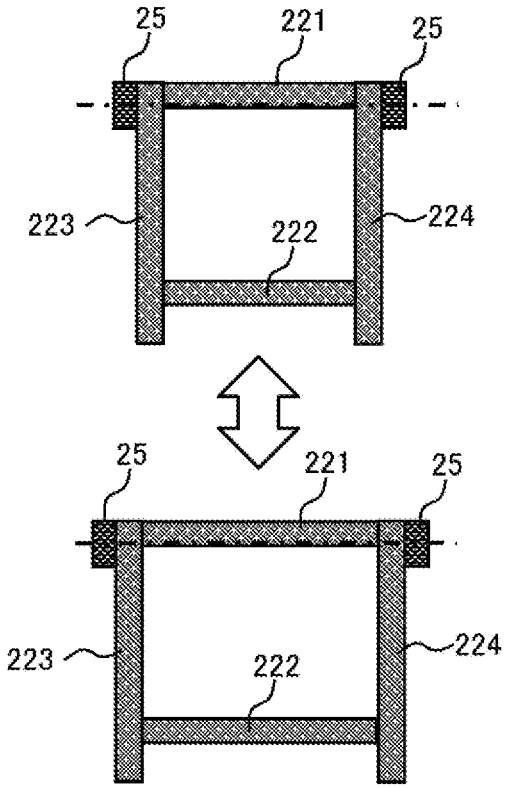
FIG. 4 is a view illustrating a configuration example of a movable part of the droplet ejection system of the embodiment.

FIG. 4 is a view illustrating a configuration example of the movable part of the droplet ejection system of the embodiment. In FIG. 4, the angle designation knob 25 is also illustrated. FIG. 4 illustrates a view of the movable part 22 as viewed from the front. The dashed-dotted line in the drawing indicates an axis of the shaft rod of the base 21. An upper part of FIG. 4 illustrates the movable part 22 when the angle A has not reached the predetermined angle. A lower part of the FIG. 4 illustrates the movable part 22 when the angle A has reached the predetermined angle.

As illustrated in FIG. 4, the movable part 22 includes a first arm 221, a second arm 222, a third arm 223, and a fourth arm 224.

The first arm 221 is positioned on an upper portion of the movable part 22, is attached to the shaft rod of the base 21, and serves as a central axis for movement of the movable part 22.

The second arm 222 is disposed on a lower portion of the movable part 22 at a position at which it can be brought into contact with the tray 12. The second arm 222 moves in a circumferential direction when it is pushed by the tray 12.

The third arm 223 connects a left side of the first arm 221 and a left side of the second arm 222. Here, the left side refers to in a negative direction of the x-axis. The third arm 223 is not completely fixed to the first arm 221 and the second arm 222, and is attached to be movable within a predetermined width in the x-axis direction.

The fourth arm 224 connects a right side of the first arm 221 and a right side of the second arm 222. Here, the right side refers to in a positive direction of the x-axis. The fourth arm 224 is not completely fixed to the first arm 221 and the second arm 222, and is attached to be movable within a predetermined width in the x-axis direction.

As illustrated in the upper part of FIG. 4, when the angle A has not reached the predetermined angle, the third arm 223 and the fourth arm 224 are in a state of being latched by the angle designation knob 25. In this state, the third arm 223 and the fourth arm 224 have a first distance therebetween. In the first distance, the ion generator 24 and the fan 26 are placed on the movable part 22.

On the other hand, as illustrated in the lower part of FIG. 4, when the angle A has reached the predetermined angle, the third arm 223 and the fourth arm 224 are in a state in which a latch by the angle designation knob 25 is released. In this state, the third arm 223 and the fourth arm 224 have a second distance therebetween that is larger than the first distance due to, for example, a force of a spring. In the second distance, the movable part 22 releases the ion generator 24 and the fan 26 from being placed. Due to this release, the ion generator 24 and the fan 26 generate an air flow on the tray 12 due to a pendulum operation of returning from the predetermined angle to the initial state due to gravity. Further, the movable part 22 maintains the second distance after the release and also maintains the predetermined angle due to the angle designation knob 25 even after the tray 12 is drawn in. Returning the state of the lower part to the state of the upper part in FIG. 4 depends on an operation of the user. Thereby, the static eliminator 20 does not need to have a complicated mechanism for returning the state of the lower part to the state of the upper part in FIG. 4, and this is suitable for cost reduction.

[Example of Detachable Static Eliminator 20]

Figure 5:
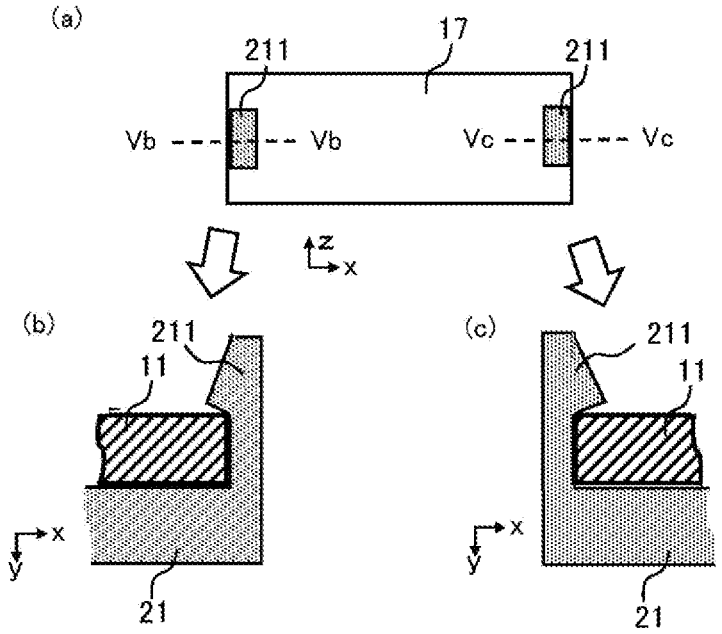
FIG. 5 is a view illustrating a configuration example in which the static eliminator of the embodiment is detachably attached to the printer device.

FIG. 5 is a view illustrating a configuration example in which the static eliminator of the embodiment is detachably attached to the printer device. FIG. 5 illustrates an example in which the base 21 is detachably attached to a tray doorway 17 on the front of the printer main body 11. (a) of FIG. 5 illustrates the doorway 17 when the front of the printer main body 11 is viewed from the y-axis direction. (b) of FIG. 5 illustrates a cross section along line Vb-Vb in (a) of FIG. 5 as viewed from the z-axis direction. (c) of FIG. 5 illustrates a cross section along line Vc-Vc in (a) of FIG. 5 as viewed from the z-axis direction.

As illustrated in FIG. 5, the base 21 includes a claw part 211 that is caught by the doorway 17. For example, the user inserts the claw part 211 of the base 21 into the doorway 17 of the printer main body 11 so that the static eliminator 20 can be mounted on the front surface of the printer main body 11 by being caught thereby. Also, the user can remove the static eliminator 20 from the printer main body 11 by pulling the base 21.

Further, the base 21 may also be detachably attached to a portion other than the doorway 17 of the printer main body 11.

Figure 6:
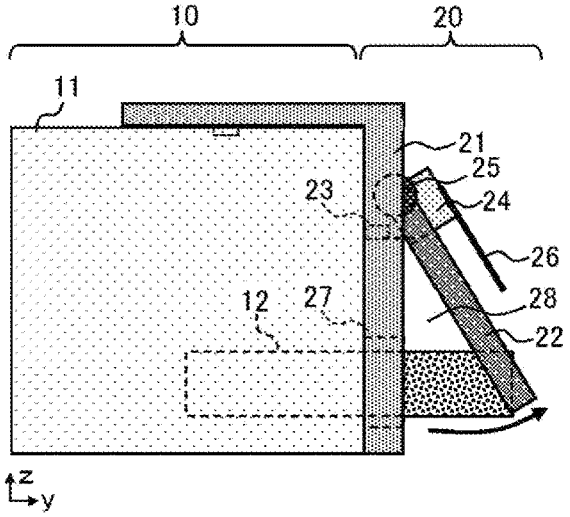
FIG. 6 is a view illustrating a modified example of the droplet ejection system of the embodiment.

FIG. 6 is a view illustrating a modified example in which the static eliminator 20 of the embodiment is detachably attached. FIG. 6 illustrates an example in which the static eliminator 20 is detachably attached utilizing a replacement port 18 on an upper surface of the printer main body 11. The replacement port 18 is for replacing the cartridge 13. FIG. 6 illustrates an example in which the base 21 is L-shaped when viewed from the lateral side and is caught by the replacement port 18 of the printer main body 11.

Figure 7:
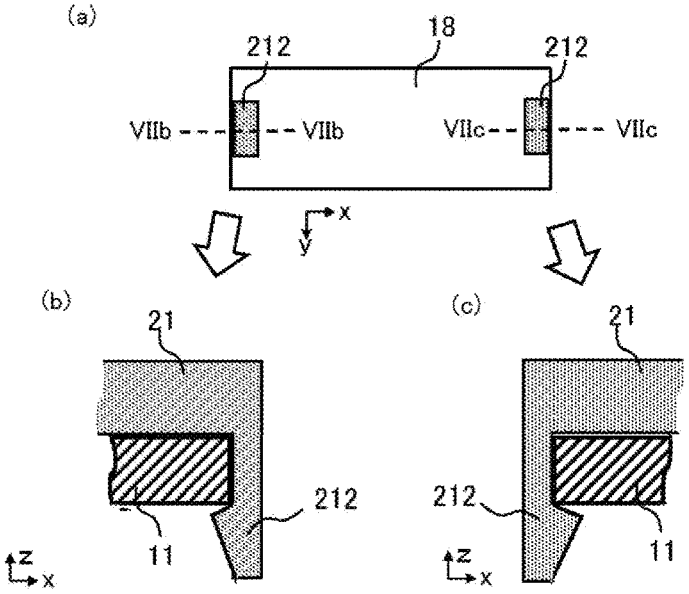
FIG. 7 is a view illustrating another configuration example in which the static eliminator of FIG. 6 is detachably attached to the printer device.

FIG. 7 is a view illustrating a configuration example in which the static eliminator 20 of FIG. 6 is detachably attached to the printer device. In FIG. 7 illustrates an example in which the base 21 is attached to and detached from the replacement port 18 for replacing the cartridge 13 on the upper surface of the printer main body 11. (a) of FIG. 7 illustrates the doorway 17 when the upper surface of the printer main body 11 is viewed from the z-axis direction. (b) of FIG. 7 illustrates a cross section along line VIIb-VIIb in (a) of FIG. 7 as viewed from the y-axis direction. (c) of FIG. 7 illustrates a cross section along line VIIc-VIIc in (a) of FIG. 7 as viewed from the y-axis direction.

As illustrated in FIG. 7, the base 21 includes a claw part 212 that is caught by the replacement port 18. For example, the user can mount the static eliminator 20 on the upper surface of the printer main body 11 to be caught thereby by inserting the claw part 212 of the base 21 into the replacement port 18 of the printer main body 11. Also, the user can remove the static eliminator 20 from the printer main body 11 by pulling the base 21.

Further, the static eliminator 20 may also be detachably attached to the printer main body 11 using a magnet or a pressure-sensitive adhesive.

[Configuration Example of Switch 23]

Figure 8:
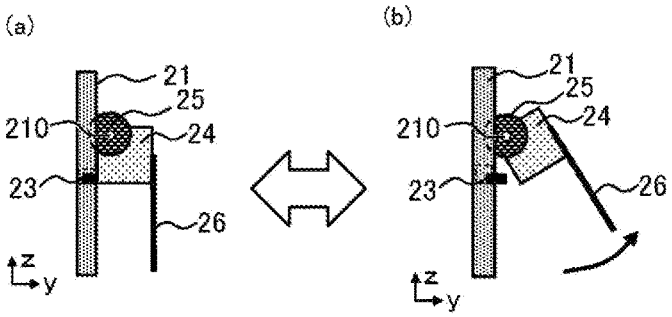
FIG. 8 is an explanatory view illustrating an example of a pressing operation of a switch by an ion generator in the static eliminator of the embodiment.

FIG. 8 is an explanatory view illustrating an example of a pressing operation of the switch 23 by the ion generator 24 in the static eliminator of the embodiment. (a) of FIG. 8 illustrates a state of the ion generator 24 when the ion generator 24 is in the initial state, that is, when the angle A is 0 degrees.

Also, it is assumed that the switch 23 is embedded in the base 21 and the button to be pressed protrudes several millimeters from the surface of the base 21. In the state (a) of FIG. 8, the angle A of the ion generator 24 is approximately 0 degrees due to gravity, and the button of the switch 23 is pushed. At this time, the switch 23 enters an OFF state.

(b) of FIG. 8 illustrates a state of the ion generator 24 when the initial state is released, that is, when the angle A is larger than 0 degrees due to movement of the movable part 22. In this state, the ion generator 24 does not press the button of the switch 23. Thereby, the switch 23 enters an ON state.

Further, the switch 23 may be pressed by the fan 26 instead of the ion generator 24.

[Configuration Example of Ion Generator 24]

Figure 9:
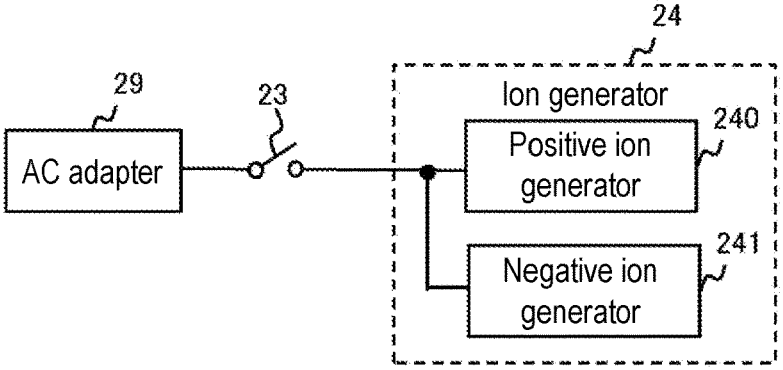
FIG. 9 is a diagram showing an example of a circuit configuration including the ion generator in the static eliminator of the embodiment.

FIG. 9 is a diagram showing an example of a circuit configuration including the ion generator 24 in the static eliminator of the embodiment. As in FIG. 9, the static eliminator 20 includes an AC adapter 29, the switch 23, and the ion generator 24 as a circuit configuration.

The AC adapter 29 is connected to an AC power supply and converts, for example, an AC power of 100 V into a DC power.

The switch 23 allows the DC power to be supplied from the AC adapter 29 to the ion generator 24 when it is in an ON state. For example, the switch 23 may be a pushbutton switch of a non-lock type as illustrated in FIG. 8.

The ion generator 24 includes a positive ion generator 240 and a negative ion generator 241 to generate positive ions and negative ions.

Further, the static eliminator 20 may include a connector that receives supply of a DC power from the printer main body 11 instead of the AC adapter. Also, the static eliminator 20 may include a battery that supplies a DC power to the ion generator 24 via the switch 23 instead of the AC adapter.

[Configuration Example of Tray 12]

Figure 10:
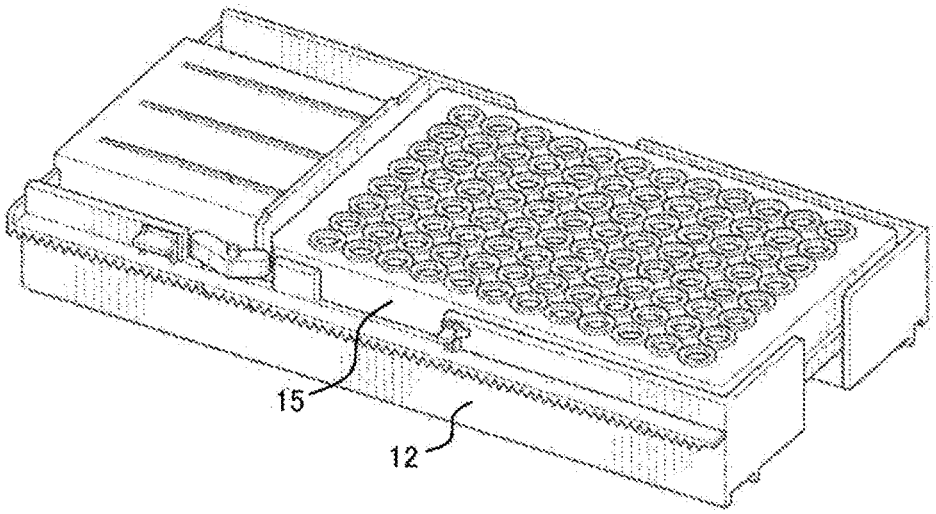
FIG. 10 is a view illustrating a configuration example of a tray of the printer device of the embodiment.

FIG. 10 is a view illustrating a configuration example of a tray of the printer device 10 of the embodiment. A well plate 15 as an object is placed on the tray 12 in FIG. 10. The well plate 15 includes a plurality of wells for dispensing a fluid that is a sample used for analysis, investigation, or research. For example, a diameter of the wells may be 7 mm or 5 mm. In this case, for example, 96 wells are disposed at 9 mm intervals. Also, a diameter of the wells may also be 3.3 mm or 3.7 mm. In this case, for example, 384 wells are disposed at 4.5 mm intervals. Further, the number of wells, a hole diameter, or an interval is not limited thereto.

Further, an example of the well plate 15, as an object on which droplets are to be ejected that is placed on the tray 12, has been illustrated in FIG. 10, but the disclosure is not limited thereto. An object may be an object to be printed on such as a CD-ROM, a DVD, or a paper medium.

[Modified Example of Static Eliminator 20]

Figure 11:
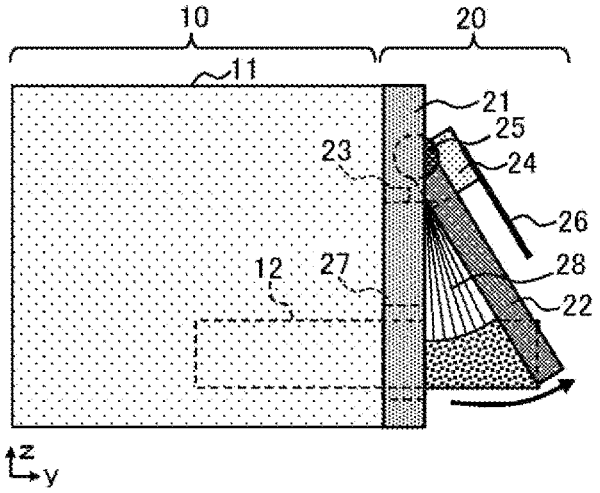
FIG. 11 is a view illustrating another modified example of the droplet ejection system of the embodiment.

FIG. 11 is a view illustrating a modified example of the static eliminator 20 of the embodiment. The static eliminator 20 in FIG. 11 is different from FIG. 1, FIG. 3A, and FIG. 3B in that a side guard 28 is added. Hereinafter, differences will be mainly described while avoiding duplication of explanations of the same points.

The side guard 28 is a foldable bellows-shaped film body connecting the base 21 and a lateral side of the fan 26. The side guard 28 is provided on both sides of the fan 26. Emission of ions from the tray can be suppressed by the side guard 28, and an efficiency of the static elimination can be further improved. Also, the side guard 28 also suppresses diffusion of ozone that is generated as a by-product of ions. Thereby, an influence on a material that is liable to deteriorate due to ozone can be suppressed.

[Operation Example of Static Eliminator 20]

Figure 12:
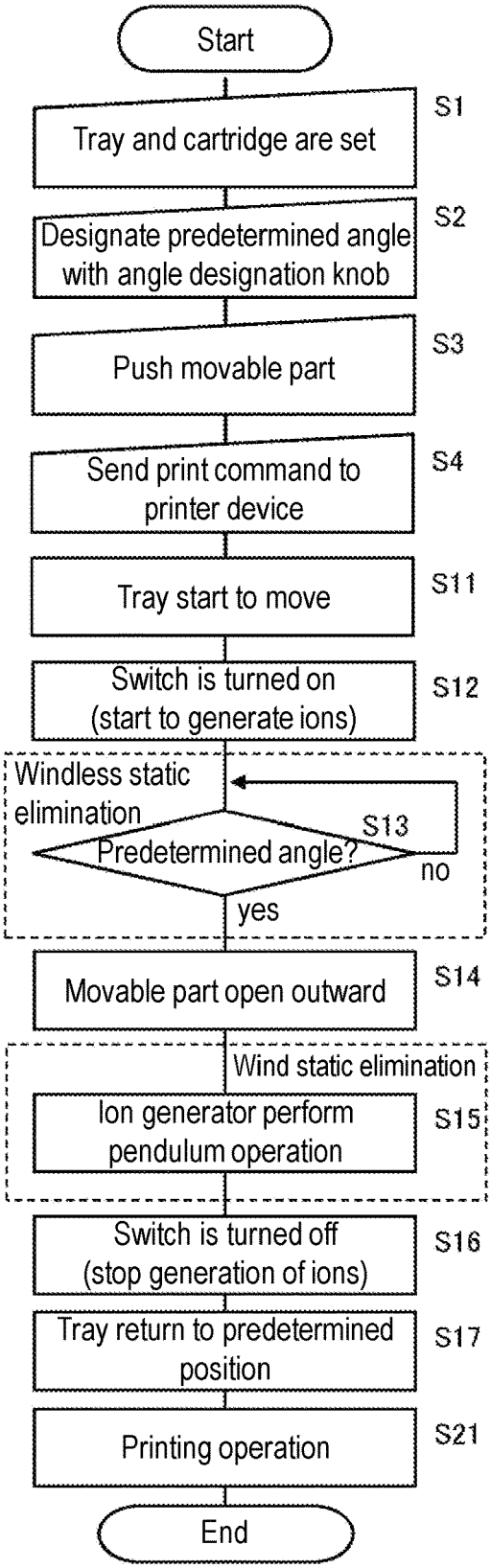
FIG. 12 is a flowchart illustrating an operation example of the droplet ejection system of the embodiment.

FIG. 12 is a flowchart illustrating an operation example of the droplet ejection system of the embodiment. In FIG. 12, steps S1 to S3 indicate operations performed by the user. Steps S11 to S17 mainly indicate operations of static elimination by the static eliminator 20. Step S21 indicates a printing operation or a dispensing operation of a sample. At this time, the printer device 10 performs an operation of sending out most of the tray 12 to the outside of the printer main body 11 over the period from steps S11 to S16, and performs an operation of drawing in the tray 12 in step S17.

First, the user sets an empty well plate 15 on the tray 12, and mounts a cartridge having a tank in which a sample is stored to the printer main body 11 (S1). Next, the user designates a predetermined angle using the angle designation knob 25 (S2). The predetermined angle is a size of the angle A on a condition under which placement of the ion generator 24 and the fan 26 on the movable part 22 is released. In a state in which the movable part 22 is opened to the predetermined angle, the user narrows a distance between the third arm 223 and the fourth arm 224 of the movable part 22 to the first distance and then pushes the movable part 22 into the initial state (S3). Further, the user sends a print command instructing a printing operation to the printer device 10 (S4).

The printer device 10 that has received the print command performs an operation of sending out the tray 12 to the outside of the printer main body 11 and an operation of drawing it in to cause the static eliminator 20 to perform the static elimination operation prior to a printing operation (S21), and then performs the printing operation.

More specifically, the printer device 10 that has received the print command starts the sending-out operation of the tray 12. Thereby, the tray 12 starts to move (S11). When the movable part 22 and the ion generator 24 are pushed out due to the movement of the tray 12, the switch 23 enters an ON state and the ion generator 24 starts to generate ions (S12). Thereby, the windless static elimination illustrated in FIG. 3A is performed until the angle A reaches the predetermined angle (no in S13).

When the movement of the tray 12 proceeds and the angle A reaches the predetermined angle (yes in S13), the movable part 22 opens outward (S14), that is, a distance between the third arm 223 and the fourth arm 224 of the movable part 22 increases from the first distance to the second distance. Thereby, the movable part 22 releases the ion generator 24 and the fan 26 from being placed. The fan 26 released from the placement performs a pendulum operation (S15). An air flow is generated on the tray 12 by the pendulum operation, and ions move on the tray 12. Thereby, the wind static elimination illustrated in FIG. 3B is performed.

Also, the ion generator 24 returns to the initial state due to the pendulum operation, the switch 23 enters an OFF state, and ion generation of the ion generator 24 stops (S16). Since the side guard 28 suppresses dissipation of the ions from above the tray 12 even when the ion generation is stopped, the static elimination action due to the ions can remain.

The printer device 10 performs an operation of drawing in the tray 12. Thereby, the tray 12 returns to a predetermined position suitable for the printing operation or the dispensing operation (S17).

As described above, as a preparation step for the printing operation, the printer device 10 performs an operation of sending out the tray 12 to the outside of the printer main body 11 and then drawing it in at least once. The static eliminator 20 performs the windless static elimination and the wind static elimination as the operation of static elimination of the tray 12 in conjunction with the sending-out and drawing-in operations of the tray 12 in the preparation stage.

According to the operation example of FIG. 12, static electricity of the tray can be efficiently eliminated in the printer device 10 which is a droplet ejection device of a tray transport type. That is, the movable part 22 and the ion generator 24 are linked with movement of the tray. For example, the ion generator 24 generates ions on the tray when the tray has moved below the ion generator 24 and does not generate ions when the tray is not positioned below the ion generator 24. In this way, unnecessary ion generation can be curbed and an efficiency of eliminating static electricity can be improved. Further, when the ion generator 24 returns from a state of the predetermined angle to the initial state, an air flow is generated on the tray by the fan 26 to move ions on the tray 12. As a result, the static eliminator 20 can perform the windless static elimination during a period from the initial state until reaching the predetermined angle, and can perform the wind static elimination when it returns from the predetermined angle to the initial state.

As described above, the static eliminator 20 according to one aspect of the embodiment eliminates static electricity from the tray 12 of a droplet ejection device having a tray transport mechanism and includes the movable part 22 that is pushed by the tray 12 due to movement of the tray 12 and moves, and the ion generator 24 disposed on a movement path of the tray 12 and configured to generate ions according to the movement of the movable part 22.

According to this, the static electricity of the tray can be efficiently eliminated in the droplet ejection device of a tray transport type. That is, the movable part 22 and the ion generator 24 are linked with the movement of the tray. For example, the ion generator 24 generates ions on the tray when the tray has moved below the ion generator 24 and does not generate ions when the tray is not positioned below the ion generator 24. In this way, unnecessary ion generation can be curbed and an efficiency of eliminating static electricity can be improved.

For example, the movable part 22 and the ion generator 24 may be disposed outside a main body of the droplet ejection device, and the ion generator 24 may generate ions in a direction toward a sent-out portion of the tray 12 in a state in which a part or all of the tray 12 has been sent out from the main body of the droplet ejection device.

According to this, the static eliminator 20 can be externally attached without changing the inside of an existing droplet ejection device.

For example, the ion generator 24 may be placed on the movable part 22.

According to this, the ion generator 24 is movable together with the movable part 22 and can generate ions at a position corresponding to the movement of the tray.

For example, the static eliminator 20 may include the switch 23 which switches between an OFF state and an ON state according to the movement of the movable part 22 or the ion generator 24, and the ion generator 24 may generate ions when the switch 23 is in the ON state.

According to this, since ions are generated when, for example, the tray has moved below the ion generator 24, the static electricity can be efficiently eliminated without generating unnecessary ions.

For example, the base 21 supporting the movable part 22, the ion generator 24, and the switch 23 and detachably attached to the droplet ejection device may be provided.

According to this, the droplet ejection device can be detachably attached to the static eliminator 20.

For example, the base 21 may have the shaft rod 210 that supports a portion of the movable part 22, and the movable part 22 may be movable to rotate around the shaft rod 210 by being pushed by the tray 12.

According to this, since the tray moves a contact portion of the movable part 22 in a circumferential direction, a load applied to the tray can be reduced.

For example, a portion of the ion generator 24 may be supported by the shaft rod 210, the other portion of the ion generator 24 may be placed on the movable part 22, and the switch 23 may be switched between an ON state and an OFF state by the movement of the ion generator 24.

According to this, the switch 23 can be switched between the ON state and the OFF state according to a rotation angle of the ion generator 24.

For example, the movable part 22 may release the ion generator 24 from being placed when an angle formed by the base 21 and the movable part 22 reaches the predetermined angle.

According to this, when the angle formed by the base 21 and the movable part 22 reaches the predetermined angle, a position of the ion generator 24 can return to the initial state to switch the switch. As a result, generation of ions can be limited only to a period from the initial state until reaching the predetermined angle and further returning to the initial state. In this way, unnecessary ion generation can be curbed, and static electricity can be efficiently eliminated.

For example, the static eliminator 20 may include the plate-shaped fan 26 attached to the ion generator 24.

According to this, when the ion generator 24 returns from a state of the predetermined angle to the initial state, an air flow can be generated on the tray by the fan 26 to move ions on the tray. In other words, the static eliminator 20 can perform the windless static elimination during the period from the initial state until reaching the predetermined angle and can perform the wind static elimination during the period from the predetermined angle until returning to the initial state.

For example, the static eliminator 20 may include the angle designation knob 25 that designates a predetermined angle.

According to this, a period of the windless static elimination can be adjusted according to until when the predetermined angle of the above-described angle is reached. For example, in a situation in which a large amount of static electricity is likely to accumulate on the tray, the predetermined angle can be designated to a large angle. Conversely, in a situation in which static electricity is unlikely to accumulate on the tray, the predetermined angle can be designated to a small angle. As a result, the static electricity can be efficiently eliminated.

For example, the static eliminator 20 may include the planar side guard that connects the base 21 and a lateral side of the fan 26.

According to this, emission of ions from the tray can be suppressed, and an efficiency of the static elimination can be further improved.

Also, the static eliminator 20 according to one aspect of the embodiment is a static eliminator that eliminates static electricity from a tray of a droplet ejection device having a tray transport mechanism and includes the movable part 22 that is pushed by the tray 12 due to movement of the tray 12 and moves, the switch 23 which switches between an OFF state and an ON state according to the movement of the movable part 22, the ion generator 24 disposed on a movement path of the tray 12 and configured to generate ions on the tray 12 according to the ON state of the switch 23, and the base 21 supporting the movable part 22, the ion generator 24, and the switch 23 and detachably attached to the droplet ejection device.

According to this, the static electricity of the tray can be efficiently eliminated in the droplet ejection device of a tray transport type. That is, the movable part 22 and the ion generator 24 are linked with movement of the tray. For example, the ion generator 24 generates ions on the tray when the tray has moved below the ion generator 24 and does not generate ions when the tray is not positioned below the ion generator 24. In this way, unnecessary ion generation can be curbed and an efficiency of eliminating static electricity can be improved.

For example, a planar fan attached to the ion generator 24 may be provided, the base 21 may include the shaft rod 210 that supports a portion of the movable part 22 and a portion of the ion generator 24, the other portion of the ion generator 24 may be placed on the movable part 22, the movable part 22 may release the ion generator 24 from being placed when an angle formed by the base 21 and the movable part 22 reaches the predetermined angle, and the ion generator 24 may return to an initial state due to the release to switch the switch.

According to this, when the ion generator 24 returns from a state of the predetermined angle to the initial state, an air flow can be generated on the tray by the fan to move ions on the tray. In other words, the static eliminator 20 can perform the windless static elimination during the period from the initial state until reaching the predetermined angle and can perform the wind static elimination during the period from the predetermined angle until returning to the initial state.

Also, the droplet ejection system 1 according to one aspect of the embodiment includes the above-described static eliminator 20 and the droplet ejection device of a tray transport type to which the static eliminator 20 is attached.

According to this, static electricity of the tray can be efficiently eliminated in the droplet ejection device of a tray transport type.

Further, an example in which the static eliminator 20 is mounted to the printer device 10 has been described in the embodiment, but the static eliminator 20 may be mounted to a device other than the printer device 10. A device other than the printer device 10 need only have, for example, a transport mechanism capable of sending out a tray or a predetermined object from the inside of the device to the outside of the device and drawing it in. In this case, the static eliminator 20 can eliminate static electricity from the predetermined object in conjunction with movement of the predetermined object.

While the static eliminator 20 and the droplet ejection system 1 according to one or more aspects of the disclosure have been described above on the basis of the embodiments, the disclosure is not limited to the embodiments. As long as it does not depart from the gist of the disclosure, a form in which various modifications conceived by those skilled in the art are applied to the present embodiments, or a form constructed by combining components in different embodiments may also be included within the scope of one or more embodiments of the disclosure.

The disclosure can be utilized for a static eliminator and a droplet ejection system that eliminate static electricity from a tray of a droplet ejection device of a tray transport type.

What is claimed is:

1. A static eliminator eliminating static electricity from a tray of a droplet ejection device having a tray transport mechanism, the static eliminator comprising:

a movable part which is pushed by the tray due to movement of the tray and moves; and an ion generator disposed on a movement path of the tray and configured to generate ions according to movement of the movable part.

2. The static eliminator according to claim 1, wherein the movable part and the ion generator are disposed outside a main body of the droplet ejection device, and the ion generator generates ions in a direction toward a sent-out portion of the tray in a state in which a part or all of the tray has been sent out from the main body of the droplet ejection device.

3. The static eliminator according to claim 1, wherein the ion generator is placed on the movable part.

4. The static eliminator according to claim 2, wherein the ion generator is placed on the movable part.

5. The static eliminator according to claim 1, further comprising:

a switch which switches between an OFF state and an ON state according to movement of the movable part or the ion generator, wherein the ion generator generates ions when the switch is in the ON state.

6. The static eliminator according to claim 2, further comprising:

a switch which switches between an OFF state and an ON state according to movement of the movable part or the ion generator, wherein the ion generator generates ions when the switch is in the ON state.

7. The static eliminator according to claim 3, further comprising:

a switch which switches between an OFF state and an ON state according to movement of the movable part or the ion generator, wherein the ion generator generates ions when the switch is in the ON state.

8. The static eliminator according to claim 5, further comprising a base which supports the movable part, the ion generator, and the switch and is detachably attached to the droplet ejection device.

9. The static eliminator according to claim 8, wherein the base includes a shaft rod which supports a portion of the movable part, and the movable part is movable to rotate around the shaft rod by being pushed by the tray.

10. The static eliminator according to claim 9, wherein a portion of the ion generator is supported by the shaft rod, the other portion of the ion generator is placed on the movable part, and the switch is switched between an ON state and an OFF state by the movement of the ion generator.

11. The static eliminator according to claim 10, wherein the movable part releases the ion generator from being placed when an angle formed by the base and the movable part reaches a predetermined angle.

12. The static eliminator according to claim 11, further comprising a plate-shaped fan attached to the ion generator.

13. The static eliminator according to claim 11, further comprising an angle designation part which designates the predetermined angle.

14. The static eliminator according to claim 12, further comprising an angle designation part which designates the predetermined angle.

15. The static eliminator according to claim 12, further comprising a planar side guard connecting the base and a lateral side of the fan.

16. A static eliminator eliminating static electricity from a tray of a droplet ejection device having a tray transport mechanism, the static eliminator comprising:

a movable part which is pushed by the tray due to movement of the tray and moves;

a switch which switches between an OFF state and an ON state according to movement of the movable part;

an ion generator disposed on a movement path of the tray and configured to generate ions on the tray according to the ON state of the switch; and a base which supports the movable part, the ion generator, and the switch and is detachably attached to the droplet ejection device.

17. The static eliminator according to claim 16, further comprising:

a planar fan attached to the ion generator, wherein the base includes a shaft rod supporting a portion of the movable part and a portion of the ion generator, the other portion of the ion generator is placed on the movable part, the movable part releases the ion generator from being placed when an angle formed by the base and the movable part reaches a predetermined angle, and the ion generator returns to an initial state due to the release to switch the switch.

18. A droplet ejection system comprising:

the static eliminator according to claim 1; and a droplet ejection device of a tray transport type to which the static eliminator is attached.

19. A method eliminating static electricity from a tray of a droplet ejection device, comprising:

enabling generation of ions when the tray starts moving out of the droplet ejection;

blowing the ions to the tray to eliminate the static electricity from the tray; and disabling the generation of the ions when the tray is sent out.

20. The method according to claim 19, wherein the generation of the ions is in a direction toward a sent-out portion of the tray in a state in which a part or all of the tray has been sent out from the droplet ejection device.

* * * * *